US007051636B1

(12) United States Patent
Snow et al.

(10) Patent No.: US 7,051,636 B1
(45) Date of Patent: May 30, 2006

(54) ELECTROMAGNETIC WEAPON

(75) Inventors: Jeffrey M. Snow, Bloomington, IN (US); Trevor M. Snow, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 121 days.

(21) Appl. No.: 10/945,573

(22) Filed: Sep. 21, 2004

(51) Int. Cl.
*B64D 1/04* (2006.01)

(52) U.S. Cl. ..... 89/1.11; 86/50; 250/341.1; 250/395

(58) Field of Classification Search ..... 89/1.11; 86/50; 250/341.1, 395
See application file for complete search history.

(56) References Cited

U.S. PATENT DOCUMENTS 4,467,328 A * 8/1984 Hacker ..... 342/14
4,765,222 A 8/1988 Pinson
4,817,495 A * 4/1989 Drobot ..... 89/1.11
4,858,511 A 8/1989 Jasper
5,052,638 A 10/1991 Minovitch
5,157,404 A * 10/1992 Rowe et al. ..... 342/372
6,298,787 B1 10/2001 Warnagiris
6,333,712 B1 * 12/2001 Haugse et al. ..... 342/375
6,359,582 B1 * 3/2002 MacAleese et al. ..... 342/22
6,477,932 B1 * 11/2002 Jung ..... 89/1.11
6,754,609 B1 6/2004 Lescourret
2006/0038714 A1 * 2/2006 Osepchuk ..... 342/22

* cited by examiner

*Primary Examiner*—J. Woodrow Eldred
(74) *Attorney, Agent, or Firm*—Mark O. Glut

(57) ABSTRACT

An electromagnetic weapon that includes semi-randomly arranged antenna elements and a central weapon computer. The antenna elements are coordinated to function as an active phased array capable of finding and executing a resonate mode of a target. The central weapon computer controls all the antenna elements, and is able to determine the location of all the antenna elements.

15 Claims, 2 Drawing Sheets

ELECTROMAGNETIC WEAPON

STATEMENT OF GOVERNMENT INTEREST

The invention described herein may be manufactured and used by or for the Government of the United States of America for governmental purposes without payment of any royalties thereon or therefor.

BACKGROUND

The present invention relates to an electromagnetic weapon. More specifically, but without limitation, the present invention relates to a phased array with dynamic and semi-randomly arranged elements that can operate as an electromagnetic weapon.

In today's complex environment there is sometimes a need for military, police, or other entities to disengage or degrade certain hostile electronic equipment, cause premature detonation, or disable hostile explosive devices at a distance. Using conventional weapons or methods to accomplish these tasks may cause unwanted casualties or damage to certain equipment. Currently, there is no weapon or system that will damage electronic systems at a distance without potentially damaging other items or injuring people.

Thus, there is a need in the art to provide an electromagnetic weapon for degrading or destroying electronics or explosive devices that incorporates the listed benefits without the limitations inherent in present methods.

SUMMARY

The present invention is directed to an electromagnetic weapon that includes semi-randomly arranged antenna elements and a central weapon computer. The antenna elements are coordinated to function as an active phased array capable of finding and exciting a resonate mode of a target. The central weapon computer controls all the antenna elements, and is able to determine the location of all the antenna elements.

It is an object of the invention to provide an electromagnetic weapon that can pinpoint and destroy or degrade electronics or detonate or disable explosive devices.

It is an object of the invention to provide an electromagnetic weapon that does not damage anything except the intended target.

DRAWINGS

Figure 1:
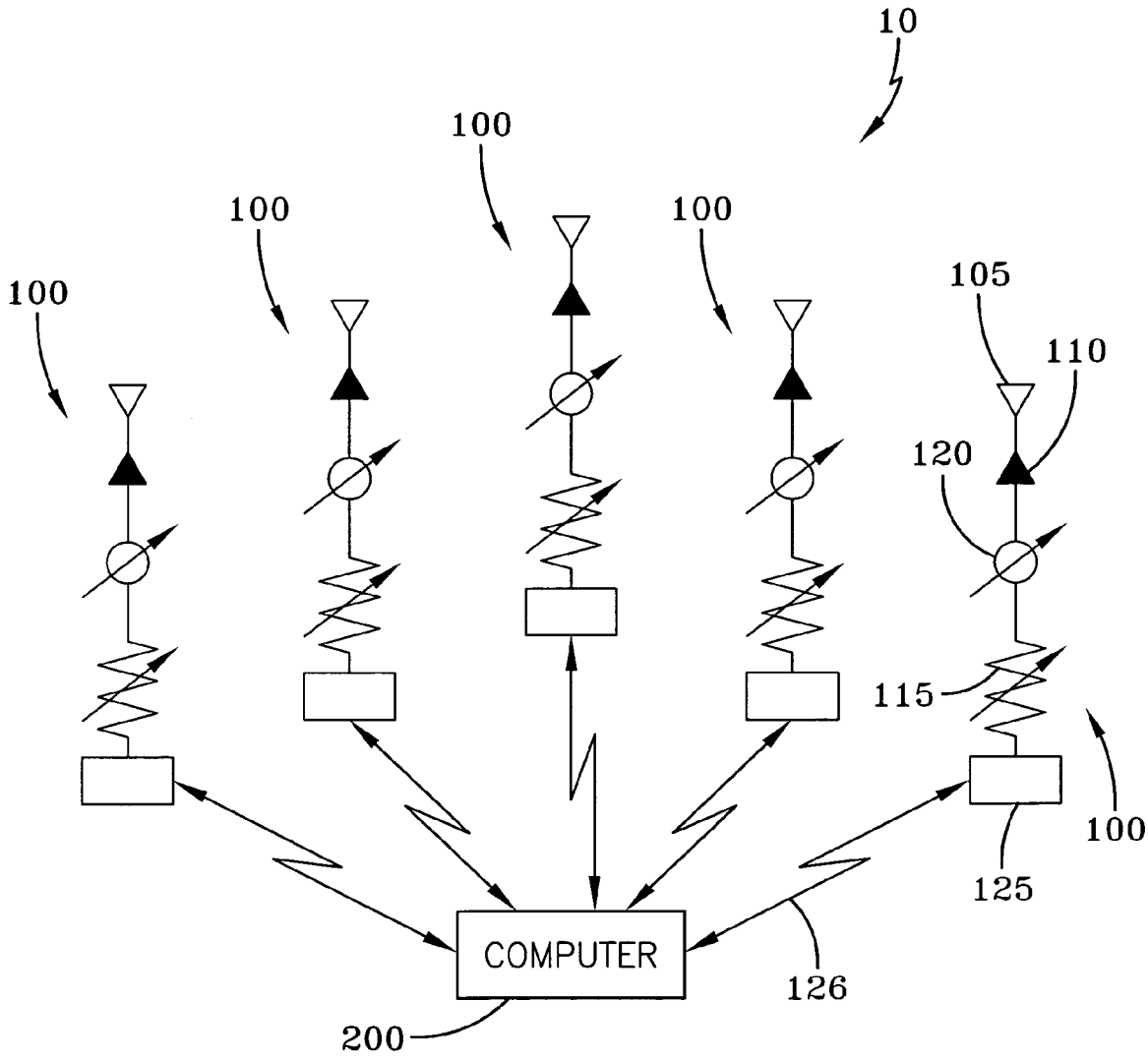
Figure 2:
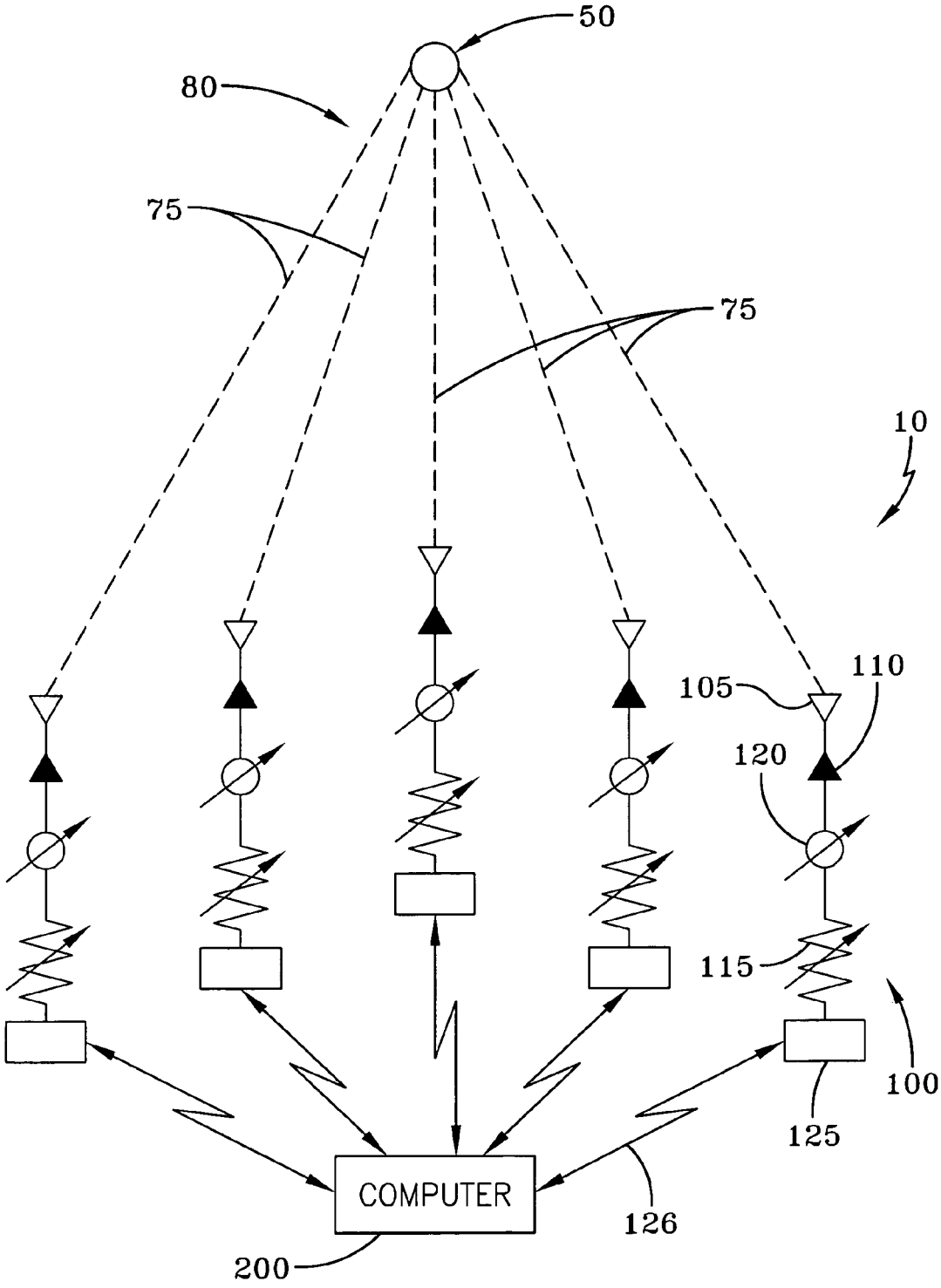

These and other features, aspects and advantages of the present invention will become better understood with reference to the following description and appended claims, and accompanying drawings wherein:

FIG. 1 is a schematic illustration of an embodiment of the electromagnetic weapon; and, FIG. 2 is schematic illustration of an embodiment of the electromagnetic weapon in operation.

DESCRIPTION

The preferred embodiments of the present invention are illustrated by way of example below and in FIGS. 1 and 2. As seen in FIG. 1, the electromagnetic weapon 10 includes semi-randomly arranged antenna elements 100 and a central weapon computer 200. The semi-randomly arranged antenna elements 100 are coordinated to function as an active phased array capable of finding and exciting the resonate mode of a target. The central weapon computer 200 controls all the antenna elements 100, and is able to determine the location of all the antenna elements 100.

An antenna element 100 may be defined, but without limitation, as an object that radiates or receives radio waves or as a conductor by which electromagnetic waves are sent out or received. The antenna elements 100 used in the electromagnetic weapon 10 may be capable of omni-directional (in azimuth) broadcasting. The antenna elements 100 may have a battery or other self powered device or be connected to an electrical source. However, the antenna elements 100 may utilize any power source practicable. The antenna elements 100 may be dipoles or loops. A dipole antenna or dipole antenna element may be defined as, but without limitation, as any one of the class of antennas producing the radiation pattern approximating that of an elementary electric dipole or an antenna consisting of two equal rods extending in opposite directions. A dipole may be defined, but without limitation, as a pair of electric point charges or magnetic poles of equal magnitude and opposite signs, separated by an infinitesimal distance. A loop antenna or loop antenna element may be defined, but without limitation, as an antenna that has one or more complete turns of conductor, excited so as to provide essentially uniform circulatory current, and producing a radiation pattern approximating that of an elementary magnetic dipole.

As seen in FIG. 1, each antenna element 100 may include a radiating element 105, an amplifier 110, an attenuator 115, a phase shifter 120, and a communications link 125 to the central weapon computer 200. The radiating element 105, the amplifier 110, the attenuator 115 and the phase shifter 120 electronically communicate with the communications link 125, while the communications link 125 electronically communicates with the central weapon computer 200.

In one of the embodiments of the electromagnetic weapon 10, the attenuator 115 may be removed or set to zero. The radiating element 105 may be a dipole or loop antenna or some other radiating element that radiates largely equally in azimuth. The amplifier 110 amplifies incoming and outgoing microwaves. In the preferred embodiment the communications link 125 is a wireless radio frequency (RF) link 125, which sends and receives signals 126 from the central weapon computer 200. However, the communications link 125 may be any type of communications link such as, but without limitation, wires, coaxial wires, optical fibers, infrared data links, laser data links, or any type of communication link or data transfer apparatus practicable. The signals 126 received from the central weapon computer 200, via the RF communications link 125, set the amount of attenuation in the attenuator 115 and the amount of phase shift in the phase shifter 120. The signals 126 sent from the antenna element 100 to the central weapon computer 200, via the RF communications link 125, indicate the strength and frequency of incoming microwaves. The attenuator 115 reduces the strength of the incoming or outgoing signals. The central weapon computer 200 can set the attenuation amount for an individual antenna element 100. This variable attenuation of individual antenna elements 100, called sidelobe tapering, can reduce the amount of energy sent or received in the sidelobes of the antenna. Sidelobes of an antenna are in directions away from the main beam where the antenna has non-trivial gain, but a gain less than the main beam, and extraneous energy is sent and received in these directions. The phase shifter 120 controls the phase of the outgoing or incoming microwave, setting the main beam direction.

In operation, each antenna element 100 sends electromagnetic energy 75 (composed of microwaves) that corresponds to the resonate mode (eigenmode) of the intended target 50. The resonate mode (eigenmode) of the intended target 50 may be defined as, but without limitation, as the frequency of electromagnetic energy that causes a peak of oscillating currents in the target. The resonate mode of a target 50 may be found, but without limitation, by sending a sharp pulse, a chirp pulse, or a series of different frequencies and looking at the strength and frequency of the returns. The peak of oscillating currents is significantly greater than would be induced by only one wavelength of electromagnetic energy. The resonating electrical currents induced in the target 50 by the antenna elements 100 would destroy or degrade electronics, possibly even damaging robust electrical systems.

The antenna elements 100 do not need to directly interact with each other. Each antenna element 100 sends out and receives microwaves in a mostly omnidirectional pattern. These individual antenna patterns can combine in a preferred direction to form a main beam or main lobe (the individual beams 75 or microwaves combined) because the phase of each element can be set. The microwaves largely cancel out in other directions (sidelobes).

The central weapon computer 200 controls all the antenna elements 100, and may via measuring time delays or phase differences or differential GPS (global positioning system) of signals between antenna elements 100 determine the location of all the antenna elements 100. The central weapon computer 200 may control the timing of emission or reception of the signals, thereby forming a large antenna array. As seen in FIG. 2, a beam of intense electromagnetic energy 80 (the beam 80 includes the individual beams 75 or microwaves) can be formed and directed toward a particular spot, target, or focal point 50.

For each arrangement of antenna elements 100 and desired main beam 80 directions or focal point 50, the central weapon computer 200 calculates each antenna element's phase shift and, optionally, the attenuation. To transmit or receive microwaves, the central weapon computer 200 sends the desired frequency, phase shift, attenuation, and start and stop time to each antenna element 100 via the communications link 125. To receive microwaves, each antenna element 100 must send to the central weapon computer 200 the strength of the received microwaves (at the desired frequency) and the phase shift of the received microwaves (received phase shift) relative to the antenna element phase shift setting. Optionally, for receiving, the central weapon computer 200 may not send the phase shift and attenuation values but apply them after receiving the strength and received phase shift information from each antenna element 100.

The semi-randomly arranged antenna elements 100 are coordinated to function as an active phased array capable of finding and exciting the resonate mode of a target 50. A greater number of antenna elements 100 and wide spacing (large aperture) of the antenna elements 100 increase the energy on the target 50. The destructive effects are greatly increased by exciting the resonate mode of the target 50. The target 50 itself acts as an integrator of the energy placed on it.

Accurate frequency and phase settings between antenna elements 100 are important for the system to work. Frequency and phase coherency may be established and maintained by several methods including, but without limitation: local oscillators in each antenna element 100 that are updated for phase matching as needed via the communications link 125, the central weapon computer 200 broadcasting several frequencies that are combined by each antenna element 100 to provide the frequency and phase reference, or the central weapon computer 200 broadcasting a frequency that is multiplied or divided by each antenna element 100. If the central weapon computer 200 broadcasts the exact frequency to be used by the antenna elements 100 interference will result.

The antenna elements 100 may be dynamic, such as on vehicles in a convoy. The central weapon computer 200 may constantly re-measure the antenna element positions and adjust the beam forming to match. The antenna elements 100 may also be strung in a line and towed behind a vehicle such as an aircraft. In another embodiment of the invention, several people or vehicles have an antenna element 100. In another embodiment, some antenna elements 100 may be stacked vertically to achieve some measure of vertical beam directional control.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. An electromagnetic weapon, comprising:

(a) semi-randomly arranged antenna elements, the antenna elements coordinated to function as an active phased array capable of finding and executing a resonate mode of a target with sufficient energy to disable the target;

(b) a central weapon computer, the central weapon computer controlling all the antenna elements, the central weapon computer being able to determine the location of all the antenna elements.

2. The electromagnetic weapon of claim 1, wherein the location of all the antenna elements are determined by measuring time delays of signals between the antenna elements.

3. The electromagnetic weapon of claim 1, wherein the location of all the antenna elements are determined by phase differences of signals between the antenna elements.

4. The electromagnetic weapon of claim 1, wherein the location of all the antenna elements are determined by differential GPS of signals between the antenna elements.

5. The electromagnetic weapon of claim 1, wherein the antenna elements are dipoles.

6. The electromagnetic weapon of claim 1, wherein the antenna elements are loops.

7. An electromagnetic weapon, comprising:

(a) semi-randomly arranged antenna elements, the antenna elements coordinated to function as an active phased array capable of finding and executing a resonate mode of a target with sufficient energy to disable the target, the antenna elements comprises of a radiating element, an amplifier, a phase shifter, and a communications link, the radiating element, the amplifier and the phase shifter electronically communicating with the communications link; and (b) a central weapon computer, the central weapon computer controlling all the antenna elements, the central weapon computer being able to determine the location of all the antenna elements, the communications link electronically communicating with the central weapon computer.

8. The electromagnetic weapon of claim 7, wherein the electromagnetic weapon further comprising an attenuator, the attenuator electronically communicating with the communications link.

9. The electromagnetic weapon of claim 8, wherein the communications link is a radio frequency link.

10. The electromagnetic weapon of claim 9, wherein the radiating element radiates largely equally in azimuth.

11. The electromagnetic weapon of claim 10, wherein the location of all the antenna elements are determined by measuring time delays of signals between the antenna elements.

12. The electromagnetic weapon of claim 10, wherein the location of all the antenna elements are determined by phase differences of signals between the antenna elements.

13. The electromagnetic weapon of claim 10, wherein the location of all the antenna elements are determined by differential GPS of signals between the antenna elements.

14. The electromagnetic weapon of claim 10, wherein the antenna elements are dipoles.

15. The electromagnetic weapon of claim 10, wherein the antenna elements are loops.

* * * * *